US006273154B1

(12) United States Patent
Laug

(10) Patent No.: US 6,273,154 B1
(45) Date of Patent: Aug. 14, 2001

(54) SUCTION-REMOVAL APPARATUS FOR SAND-BLASTING AND LIQUID PRESSURE NOZZLES

(76) Inventor: Horst Laug, Haselünner Strasse 73, D-49809 Lingen (DE)

( * ) Notice: Subject to any disclaimer, the term of this patent is extended or adjusted under 35 U.S.C. 154(b) by 0 days.

(21) Appl. No.: 09/621,912

(22) Filed: Jul. 24, 2000

Related U.S. Application Data

(63) Continuation of application No. PCT/DE99/00145, filed on Jan. 21, 1999.

(30) Foreign Application Priority Data

Jan. 22, 1998 (DE) ..... 198 02 308

(51) Int. Cl.[7] ..... B65B 1/04; B24C 3/06

(52) U.S. Cl. ..... 141/97; 239/120; 451/87; 451/89

(58) Field of Search ..... 141/98, 65, 59, 141/97; 239/120, 104; 451/488, 75, 87, 88, 89

(56) References Cited

U.S. PATENT DOCUMENTS 4,375,740 * 3/1983 Brown ..... 51/425

4,984,396 * 1/1991 Urakami ..... 51/424

* cited by examiner

*Primary Examiner*—Steven O. Douglas
(74) *Attorney, Agent, or Firm*—Herbert L. Lerner; Laurence A. Greenberg; Werner H. Stemer

(57) ABSTRACT

During blasting work, large quantities of blasting material (granules, glass, beads, slag and sand) together with residues of blasted color coating are projected over a large area after impact with the surface being blasted. This results in the pollution of large areas of the surrounding environment. The large quantities of dust produced cause problems for the population over a much wider area. The novel suction device prevents blasting material, dust and liquids from escaping from the blasting site and the area immediately surrounding the blast nozzle into the environment during blasting work. A second suction system which functions separately allows the device, with its integrated blast pressure nozzle, to hold itself steady automatically, even in extreme working positions, such as overhead, hereby relieving the operator of this task, and can still be moved laterally in any direction. The high suction capacity of the device ensures that the blasting material or liquids which rebound or are projected off of the surface during blasting work are extracted without leaving a residue and collected in containers. The inventive suction device can also be used for drying the expansion joints of concrete slabs etc. and prevents the pollution of the environment with residues of dust, joint material and chemical material.

25 Claims, 1 Drawing Sheet

SUCTION-REMOVAL APPARATUS FOR SAND-BLASTING AND LIQUID PRESSURE NOZZLES

CROSS-REFERENCE TO RELATED APPLICATION

This is a continuation of copending International Application PCT/DE99/00145, filed Jan. 21, 1999, which designated the United States.

BACKGROUND OF THE INVENTION

Field of the Invention:

The invention lies in the mechanical and fluid mechanical fields. More specifically, the invention relates to an apparatus for the suction removal of dust and/or liquids produced during pressure blasting operations with sandblasting or liquid pressure nozzles.

During blasting work, large quantities of blasting material (granules, glass, beads, slag and sand) together with residues of blasted color coating are projected over a large area after impact with the surface being blasted. This results in the pollution of large areas of the surrounding environment. The large quantities of dust produced cause problems for the population over a much wider area.

SUMMARY OF THE INVENTION

The object of the invention is to provide a suction-removal apparatus for the real-time removal of pressure blasting residues which overcomes the above-noted deficiencies and disadvantages of the prior art devices and methods of this kind, and which easily adapts to various kinds of work area surfaces, including uneven surfaces, and which, despite its suction attachment to the work area, can be relatively easily moved along the work area surface (in two degrees of freedom) without becoming detached from the surface.

With the above and other objects in view there is provided, in accordance with the invention, a suction-removal apparatus for sand-blasting and liquid pressure nozzles, comprising:

a double-wall protective shroud enclosing a blasting chamber to be placed on a surface of a work area, the protective shroud having two walls defining a cavity there-between and a surrounding suction channel communicating with a first suction-removal system for removing by suction from a contact surface between the protective shroud and the surface of the work area blasting products generated at the work area;

a second, independent suction-removal system including a plurality of suction pipe connection stubs protruding through the double-wall protective shroud into the blasting chamber and distributed about an entire periphery of the protective shroud;

an inner blasting-pressure nozzle enclosed in a surrounding suction pipe and being adjustably and movably mounted in the protective shroud;

deflection devices selected from the group consisting of baffles, deflection plates, and profiles mounted inside the protective shroud for deflecting blasting material or liquids directly to the suction pipe connection stubs; and rolling devices mounted on the protective shroud for placement in contact with the surface of the work area for allowing a displacement of the protective shroud relative to the surface in spite of a suction attachment of the protective shroud during an operation of the suction-removal apparatus.

With the novel invention, dust particles and blasting particles propelled away during blasting work, as well as liquids and remains of blasted-off coating, are removed by suction directly from the area of effectiveness and proximity of the blasting-pressure nozzles or chipping or drilling devices from all sides simultaneously in a way corresponding to the blasting pressure. The dust or other removal products are directed into receptacles.

In accordance with an added feature of the invention, one or more suction pipe connection stubs are mounted on an outer surface of the protective shroud and communicating with and generating a negative pressure in the cavity. Preferably, the suction pipe connection stubs are formed with suction openings that are funnel-shaped, semicircular, triangular, oval, rectangular, square, or round.

In accordance with another feature of the invention, suction manifold lines interconnect the suction pipe connection stubs and connect to a respective the suction-removal system. The suction pipe connection stubs are rigidly, jointed, or movably connected to the suction manifold lines.

In accordance with an additional feature of the invention, at least one collection receptacle is connected to the suction-removal system and a limit switch associated with the collection receptacle for switching off a blasting pressure when the receptacle is fully loaded, without immediately interrupting a suction removal via the suction manifold lines.

In accordance with a further feature of the invention, sealing strips are attached in a vicinity of the suction channel, only inside, only outside, or on both sides of the suction channel.

In accordance with again an added feature of the invention, the protective shroud is formed of individual segments enclosing the surface and height-adjustably mounted, and displaceably fixed with respect to one another to adapt automatically to uneven surface contours of the work area. In a preferred embodiment, the protective shroud is foldable and bendable to angles of various degrees, for reliably covering grooves in the work area.

In accordance with again an additional feature of the invention, the enclosing suction pipe with the blasting-pressure nozzle fastened inside thereof is inserted into the blasting chamber inside the protective shroud and mounted therein to be adjustable in height, and displacable to be fixed in a variety of positions relative to the protective shroud. The enclosing suction pipe is preferably mounted so as to protrude through a passage in the double-wall of the protective shroud.

In accordance with again another feature of the invention, the blasting-pressure nozzle has an outer periphery provided with at least one individual suction-removal pipe.

In accordance with again a further feature of the invention, a suction power and intensity at the suction channel and in the blasting chamber is automatically adjusted in dependence on a blasting pressure.

In accordance with yet an added feature of the invention, the rolling devices are height-adjustably, swingably, and lockably mounted. In a preferred embodiment, the rolling devices are driven rollers which are either mechanically driven, by compressed air, or with hydraulic fluid.

In accordance with yet an additional feature of the invention, the deflection devices at the suction channel are held in position by spring force and are articulated on an inner wall of the protective shroud. Preferably, the deflection devices are arranged inside the protective shroud in various positions and directions in a spiral or helical order, or alternatively in straight alignment.

In accordance with yet another feature of the invention, the deflection devices protrude substantially perpendicular from an inner wall surface of the protective shroud.

With the above and other objects in view there is also provided, in accordance with the invention, a suction-removal apparatus for sand-blasting and liquid pressure nozzles, comprising:

a protective shroud enclosing a blasting chamber to be placed on a surface of a work area;

a suction-removal system communicating with the blasting chamber inside the protective shroud, the suction-removal system including a plurality of suction pipe connection stubs protruding into the blasting chamber and distributed about the protective shroud;

an inner blasting-pressure nozzle projecting into the blasting chamber in the protective shroud and being adjustably and movably mounted at the protective shroud;

deflection devices selected from the group consisting of baffles, deflection plates, and profiles mounted inside the protective shroud for deflecting blasting material or liquids directly to the suction pipe connection stubs; and rolling devices mounted on the protective shroud for placement in contact with the surface of the work area for allowing a displacement of the protective shroud relative to the surface in spite of a suction attachment of the protective shroud during an operation of the suction-removal apparatus.

In this single-walled shroud, therefore, the removal suction is essentially driven by a single vacuum system.

In accordance with an added feature of the invention, the suction pipe connection stubs communicate with nozzles of variously formed shapes distributed over a periphery of the protective shroud.

In accordance with an additional feature of the invention, some of the rolling devices are sensing rollers for selectively lowering and raising partial enclosing surfaces of the protective shroud when the protective shroud travels over uneven contours on the surface of the work space.

In accordance with a concomitant feature of the invention, there are provided separate receptacles communicating with the suction lines. The receptacles having filling-level indicators and limit switches.

Other features which are considered as characteristic for the invention are set forth in the appended claims.

Although the invention is illustrated and described herein as embodied in a suction-removal device for pressure blasting residues, it is nevertheless not intended to be limited to the details shown, since various modifications and structural changes may be made therein without departing from the spirit of the invention and within the scope and range of equivalents of the claims.

The construction of the invention, however, together with additional objects and advantages thereof will be best understood from the following description of the specific embodiment when read in connection with the accompanying drawings.

DESCRIPTION OF THE PREFERRED EMBODIMENTS

Figure 1:
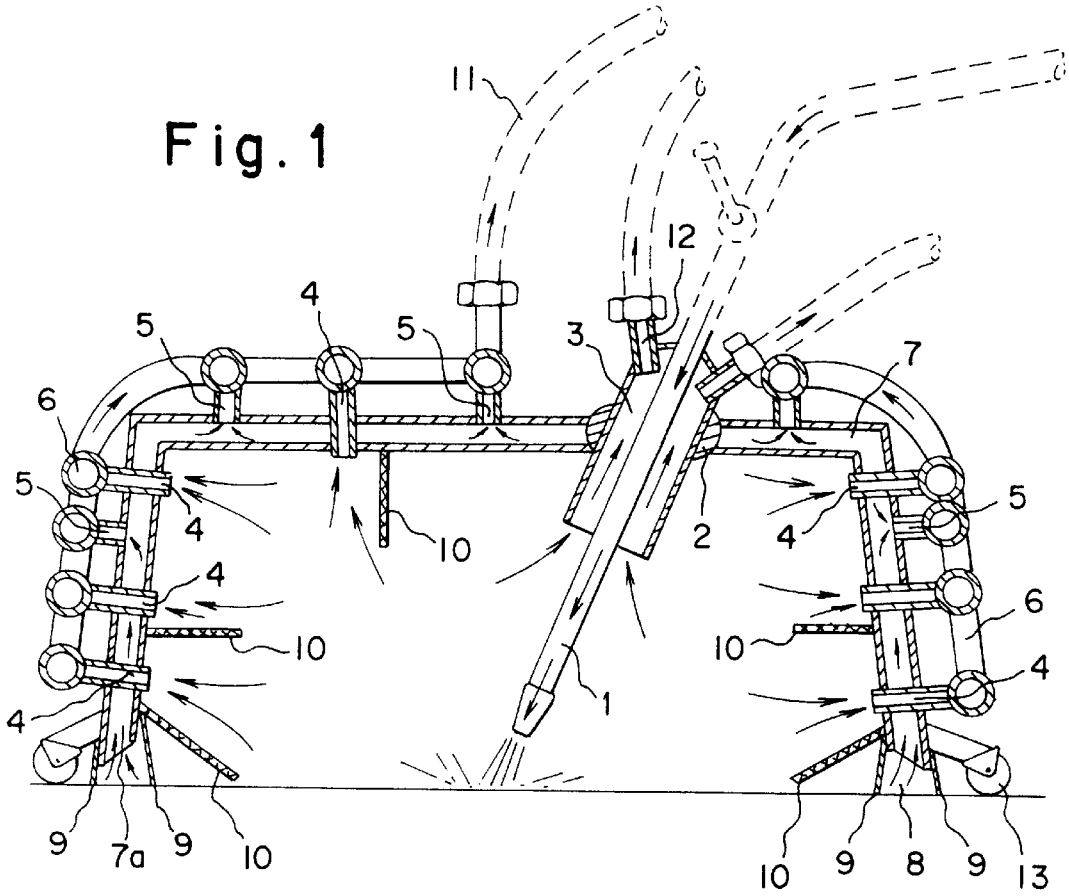
FIG. 1 is a diagrammatic section view of the suction removal device and blasting nozzle according to the invention.
Figure 2:
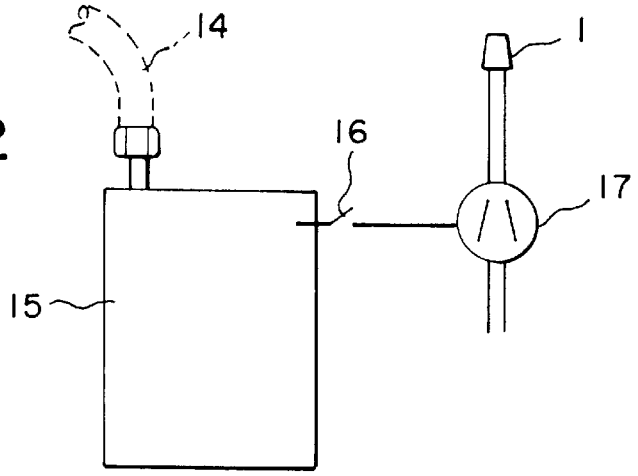
FIG. 2 is a diagrammatic view of a residue collection receptacle connected to the removal system.

Referring now to the figures of the drawing in detail and first, particularly, to FIG. 1 thereof, there is seen a blasting nozzle 1 with which a surface is pressure-blasted. The blasting nozzle 1 is encased in a double-walled shroud 7. During the blasting, a separately acting second suction-removal system over a cavity 7*a* of the double-wall protective shroud 7 is sucked against the working surface with the entire periphery. Accordingly, even in "overhead positions" the double-wall protective shroud 7 itself is firmly secured but can be laterally displaced in all directions with the aid of supporting rollers 13 or balls. The suction power of the second suction-removal system likewise automatically adapts itself to the blasting pressure. As a result, the possibility of the double-wall protective shroud 7 lifting off and of possible blasted-off remains escaping is ruled out with certainty.

The very high suction-removal power from the space inside the double-wall protective shroud 7 is achieved because the first suction-removal system can act via a plurality of suction pipe connection stubs 4, arranged in such a way that they are distributed over the entire surface of the double-wall protective shroud 7 and inserted through into the inner space, directly around the blasting area from all sides simultaneously with the aid of suction turbines.

The suction pipe connection stubs 4 and 5 are connected via collection lines 14 to closed collecting receptacles 15 via suction manifold pipelines 6 in a way corresponding to the separate suction-removal systems. The collecting receptacles 15 are equipped with limit switches 16, which bring about a switching off of the blasting pressure of the compressors 17, but can ensure continued operation of the suction removal.

The figure shows an exemplary embodiment. The blasting-pressure nozzle 1 is located in an enclosing suction pipe 3, which is open on the nozzle opening side and closed at the other end, and is provided with suction pipe connection stubs 12 at which suction lines 11 are connected.

The blasting-pressure nozzle 1 with enclosing suction pipe 3 has been inserted into the space inside a double-wall protective shroud 7 and fastened in a height-adjustable, jointed, displaceable or rigid manner in the area of the passage through the double wall 2.

The double-wall protective shroud 7 comprises a double wall, the cavity of which is formed by spacing cross-pieces between the walls. Fitted on the outer surface of the double-wall protective shroud 7 in such a way that they are distributed around the periphery are a plurality of suction pipe connection stubs 5, which are connected to one another by a dedicated suction manifold line 6 and are additionally connected to a separate suction unit or suction turbine, as well as to collecting receptacles.

The lower edge of the double-wall protective shroud 7 is formed with a wide slot, which extends over the entire periphery, is created by the cavity 7*a* of the double wall and forms a suction channel 8. At the end or on both sides of the suction channel 8 there is or are one or more sealing strips 9 of elastic material.

Fastened to the outer periphery of the suction channel 8 are supporting rollers 13, which make displacement possible in spite of strong suction attachment. For the second suction-removal system, a plurality of suction pipe connection stubs 4, arranged in such a way that they are distributed over the entire surface, are fitted in a rigid manner in such a way that they protrude through the double wall into the space inside the double-wall protective shroud 7. These suction pipe connection stubs 4 are likewise connected to dedicated suction manifold lines 6, a dedicated suction turbine and collecting receptacles.

Fastened to the inner side of the wall of the double-wall protective shroud 7 are baffle or deflection plates 10 or profiles, arranged in various positions and directions around the periphery at an angle and straight out, i.e. perpendicular to the wall. In an advantageous way, the baffle or deflection plates 10 may be positioned in a spiral or rib-like manner.

The baffle and deflection plates 10 or profiles bring about a slowing down of the blasting pressure impinging on and reflecting from the surface, as well as a deflection and direct feeding of the blasting material or liquids to the nearest suction pipe connection stubs 4. The baffle and deflection plates 10 or profiles, fastened in a jointed manner in the area of proximity of the suction channel 8 and held in position by spring force, prevent possibly excessive amounts of blasting material from already being sucked away unhindered in the suction channel 8 of the other suction-removal system if the blasting-pressure nozzle 1 is inclined too much.

Special types of design of the suction-removal apparatus have a double-wall protective shroud 7 comprising individual segments or enclosing parts of the surface, which are connected in such a way that they are height-adjustable with respect to one another and adapt themselves with the aid of supporting rollers 13 by raising or lowering in a way corresponding to the uneven contours of a surface.

I claim:

1. A suction-removal apparatus for sand-blasting and liquid pressure nozzles, comprising:

a double-wall protective shroud enclosing a blasting chamber to be placed on a surface of a work area, said protective shroud having two walls defining a cavity there-between and a surrounding suction channel communicating with a first suction-removal system for removing by suction from a contact surface between said protective shroud and the surface of the work area blasting products generated at the work area;

a second, independent suction-removal system including a plurality of suction pipe connection stubs protruding through said double-wall protective shroud into said blasting chamber and distributed about an entire periphery of said protective shroud;

an inner blasting-pressure nozzle enclosed in a surrounding suction pipe and being adjustably and movably mounted in said protective shroud;

deflection devices selected from the group consisting of baffles, deflection plates, and profiles mounted inside said protective shroud for deflecting blasting material or liquids directly to said suction pipe connection stubs; and rolling devices mounted on said protective shroud for placement in contact with the surface of the work area for allowing a displacement of said protective shroud relative to the surface in spite of a suction attachment of said protective shroud during an operation of the suction-removal apparatus.

2. The suction-removal apparatus according to claim 1, which comprises one or more suction pipe connection stubs mounted on an outer surface of said protective shroud and communicating with and generating a negative pressure in said cavity.

3. The suction-removal apparatus according to claim 1, wherein said suction pipe connection stubs are formed with suction openings having a shape selected from the group consisting of a funnel shape, semicircular, triangular, oval, rectangular, square, and round.

4. The suction-removal apparatus according to claim 1, which comprises suction manifold lines interconnecting said suction pipe connection stubs and connected to a respective said suction-removal system.

5. The suction-removal apparatus according to claim 1, wherein said suction pipe connection stubs are rigidly, jointed, or movably connected to said suction manifold lines.

6. The suction-removal apparatus according to claim 1, which comprises at least one collection receptacle connected to said suction-removal system and a limit switch associated with said collection receptacle for switching off a blasting pressure when said receptacle is fully loaded, without immediately interrupting a suction removal via said suction manifold lines.

7. The suction-removal apparatus according to claim 1, which comprises sealing strips attached in a vicinity of said suction channel.

8. The suction-removal apparatus according to claim 1, wherein said protective shroud is formed of individual segments enclosing the surface and height-adjustably mounted, and displaceably fixed with respect to one another to adapt automatically to uneven surface contours of the work area.

9. The suction-removal apparatus according to claim 1, wherein said protective shroud is foldable and bendable to angles of various degrees, for reliably covering grooves in the work area.

10. The suction-removal apparatus according to claim 1, wherein said enclosing suction pipe with said blasting-pressure nozzle fastened inside thereof is inserted into said blasting chamber inside said protective shroud and mounted therein to be adjustable in height, and displacable to be fixed in a variety of positions relative to said protective shroud.

11. The suction-removal apparatus according to claim 10, wherein said protective shroud is formed with a passage in said double-wall and said suction pipe is mounted in said passage.

12. The suction-removal apparatus according to claim 1, wherein said blasting-pressure nozzle has an outer periphery provided with at least one individual suction-removal pipe.

13. The suction-removal apparatus according to claim 1, wherein a suction power and intensity at said suction channel and in said blasting chamber is automatically adjusted in dependence on a blasting pressure.

14. The suction-removal apparatus according to claim 1, wherein said rolling devices are height-adjustably, swingably, and lockably mounted.

15. The suction-removal apparatus according to claim 1, wherein said rolling devices are driven rollers.

16. The suction-removal apparatus according to claim 15, wherein said rollers are driven in accordance with one of a mechanical drive, with compressed air, and with hydraulic fluid.

17. The suction-removal apparatus according to claim 1, wherein said deflection devices at said suction channel are held in position by spring force and are articulated on an inner wall of said protective shroud.

18. The suction-removal apparatus according to claim 1, wherein said deflection devices are arranged inside said protective shroud in various positions and directions in a spiral or helical order.

19. The suction-removal apparatus according to claim 1, wherein said deflection devices protrude substantially perpendicular from an inner wall surface of said protective shroud.

20. The suction-removal apparatus according to claim 1, wherein some of said rolling devices are sensing rollers for selectively lowering and raising partial enclosing surfaces of said protective shroud when said protective shroud travels over uneven contours on the surface of the work space.

21. The suction-removal apparatus according to claim 1, which comprises separate, receptacles communicating with said suction lines, said receptacles having filling-level indicators and limit switches.

22. The apparatus according to claim 1, wherein said rolling devices are selected from the group consisting of supporting rollers and balls.

23. A suction-removal apparatus for sand-blasting and liquid pressure nozzles, comprising:

a protective shroud enclosing a blasting chamber to be placed on a surface of a work area;

a suction-removal system communicating with said blasting chamber inside said protective shroud, said suction-removal system including a plurality of suction pipe connection stubs protruding into said blasting chamber and distributed about said protective shroud;

an inner blasting-pressure nozzle projecting into said blasting chamber in said protective shroud and being adjustably and movably mounted at said protective shroud;

deflection devices selected from the group consisting of baffles, deflection plates, and profiles mounted inside said protective shroud for deflecting blasting material or liquids directly to said suction pipe connection stubs; and rolling devices mounted on said protective shroud for placement in contact with the surface of the work area for allowing a displacement of said protective shroud relative to the surface in spite of a suction attachment of said protective shroud during an operation of the suction-removal apparatus.

24. The suction-removal apparatus according to claim 23, wherein said suction pipe connection stubs communicate with nozzles of variously formed shapes distributed over a periphery of said protective shroud.

25. The suction-removal apparatus according to claim 23, wherein some of said rolling devices are sensing rollers for selectively lowering and raising partial enclosing surfaces of said protective shroud when said protective shroud travels over uneven contours on the surface of the work space.

* * * * *